US011207763B2

(12) United States Patent
Tanji et al.

(10) Patent No.: US 11,207,763 B2
(45) Date of Patent: Dec. 28, 2021

(54) SIGNAL PROCESSING APPARATUS FOR TOOL COMPRISING ROTATING BODY ROTATED BY IMPACTS DELIVERED FROM DRIVE APPARATUS

(71) Applicant: Panasonic Intellectual Property Management Co., Ltd., Osaka (JP)

(72) Inventors: Yusuke Tanji, Osaka (JP); Hideki Tamura, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 54 days.

(21) Appl. No.: 16/641,350

(22) PCT Filed: Jun. 27, 2018

(86) PCT No.: PCT/JP2018/024412
§ 371 (c)(1),
(2) Date: Feb. 24, 2020

(87) PCT Pub. No.: WO2019/044146
PCT Pub. Date: Mar. 7, 2019

(65) Prior Publication Data

US 2020/0384618 A1 Dec. 10, 2020

(30) Foreign Application Priority Data

Aug. 29, 2017 (JP) ..... JP2017-164458

(51) Int. Cl.
*B25B 21/02* (2006.01)
*B25B 23/147* (2006.01)
*B25B 23/14* (2006.01)

(52) U.S. Cl.
CPC ..... *B25B 21/02* (2013.01); *B25B 23/1475* (2013.01); *B25B 23/1405* (2013.01); *B25D 2250/221* (2013.01)

(58) Field of Classification Search
CPC . B25B 21/02; B25B 23/1475; B25B 23/1405; B25B 23/14; B25D 2250/221
(Continued)

(56) References Cited

U.S. PATENT DOCUMENTS 4,056,762 A * 11/1977 Schadlich ..... B25B 23/1475 318/484
4,361,945 A * 12/1982 Eshghy ..... B23P 19/066 173/183
(Continued)

FOREIGN PATENT DOCUMENTS

JP S57-48484 A 3/1982
JP H01-111368 U 7/1989
(Continued)

OTHER PUBLICATIONS

Extended European Search Report corresponding application No. 18850424.5, dated Oct. 16, 2020.
(Continued)

*Primary Examiner* — Valentin Neacsu
*Assistant Examiner* — Jacob A Smith
(74) *Attorney, Agent, or Firm* — Renner, Otto, Boisselle & Sklar, LLP

(57) ABSTRACT

A signal processing apparatus for a tool including a rotating body rotated by impacts delivered from a drive apparatus is provided with: a filter a calculation circuit and a control circuit. The filter receives a torque value signal indicating a torque applied to the rotating body, and filters the torque value signal. The calculation circuit sets a filter coefficient of the filter based on a number of impacts delivered to the rotating body. The control circuit controls the impacts delivered to the rotating body, based on the torque value signal filtered by the filter.

8 Claims, 9 Drawing Sheets

(58) Field of Classification Search
USPC ..... 173/93.5
See application file for complete search history.

(56) References Cited

U.S. PATENT DOCUMENTS

| | | | | |
|---|---|---|---|---|
| 5,289,885 | A * | 3/1994 | Sakoh | B25B 23/1405 173/109 |
| 5,659,131 | A * | 8/1997 | Kono | G05B 19/4065 408/16 |
| 6,424,747 | B1 | 7/2002 | Morikawa | |
| 9,579,776 | B2 * | 2/2017 | Arimura | H02P 7/295 |
| 2002/0020538 | A1 * | 2/2002 | Giardino | B25B 23/1405 173/176 |
| 2003/0149508 | A1 * | 8/2003 | Watanabe | B25B 23/1405 700/168 |
| 2005/0109519 | A1 * | 5/2005 | Kawai | B25B 23/1405 173/183 |
| 2005/0109520 | A1 * | 5/2005 | Kawai | G05D 17/02 173/183 |
| 2009/0084568 | A1 | 4/2009 | Arimura | |
| 2013/0133912 | A1 * | 5/2013 | Mizuno | B25B 23/1405 173/180 |
| 2014/0102741 | A1 * | 4/2014 | Sekino | B25B 23/1405 173/181 |
| 2015/0021062 | A1 * | 1/2015 | Sekino | B25B 23/1453 173/183 |
| 2015/0303842 | A1 * | 10/2015 | Takano | H02P 6/30 173/2 |
| 2016/0311094 | A1 * | 10/2016 | Mergener | B25B 23/1475 |
| 2016/0325414 | A1 * | 11/2016 | Mizuno | B25B 23/1475 |
| 2017/0151657 | A1 * | 6/2017 | Nagasaka | H01H 13/08 |
| 2017/0246732 | A1 * | 8/2017 | Dey, IV | G01D 5/2006 |
| 2018/0272511 | A1 * | 9/2018 | Sako | B25B 21/02 |
| 2020/0130153 | A1 * | 4/2020 | Yoneda | B25B 23/147 |
| 2020/0324397 | A1 * | 10/2020 | Brunner | B25B 23/1475 |
| 2020/0384618 | A1 * | 12/2020 | Tanji | B25B 23/1475 |
| 2020/0384620 | A1 * | 12/2020 | Gaul | B25B 23/1475 |
| 2021/0053196 | A1 * | 2/2021 | Tanji | B25B 23/1405 |

FOREIGN PATENT DOCUMENTS

| | | | | |
|---|---|---|---|---|
| JP | H06-206127 | A | 7/1994 | |
| JP | H09-267272 | A | 10/1997 | |
| JP | H11267981 | A * | 1/1998 | B25B 21/02 |
| JP | H11-155077 | A | 6/1999 | |
| JP | 11267981 | A * | 10/1999 | B25B 21/02 |
| JP | H11-267981 | A | 10/1999 | |
| JP | 2009-083002 | A | 4/2009 | |
| JP | 2009-83038 | A | 4/2009 | |
| JP | 2009-172740 | A | 8/2009 | |
| JP | 2014184515 | A * | 3/2013 | B25B 21/02 |
| JP | 2014-127903 | A | 7/2014 | |
| JP | 2014-184515 | A | 10/2014 | |

OTHER PUBLICATIONS

Notice of Reasons for Refusal for corresponding Japanese Patent Application No. 2019-539009, dated Oct. 6, 2020.
International Search Report for corresponding Application No. PCT/JP2018/024412, dated Aug. 14, 2018.
First Chinese Office Action for Corresponding Application No. 201880052205.0 dated Feb. 20, 2021, including Notiification of Reasons for Refusal, Search Report and English translations thereof.
International Preliminary Report on Patentability for corresponding Application No. PCT/JP2018/024412, filed Jun. 27, 2018.

* cited by examiner

SIGNAL PROCESSING APPARATUS FOR TOOL COMPRISING ROTATING BODY ROTATED BY IMPACTS DELIVERED FROM DRIVE APPARATUS

TECHNICAL FIELD

The present disclosure relates to a signal processing apparatus for a tool provided with a rotating body rotated by impacts delivered from a drive apparatus, and relates to a tool provided with such a signal processing apparatus.

BACKGROUND ART

Tools provided with a rotating body rotated by impacts delivered from a drive apparatus, such as an impact driver and an impact wrench, are known (hereinafter, also referred to as "rotary impact tool").

Patent Document 1 discloses a rotary impact tool in which a motor rotates a hammer, and the hammer's impact torque is delivered to a target to be fastened, thus generating a tightening torque.

CITATION LIST

Patent Documents

PATENT DOCUMENT 1: Japanese Patent Laid-open Publication No. 2009-083002 A

SUMMARY OF INVENTION

Technical Problem

Some rotary impact tools control a drive apparatus, such as a motor, based on a torque applied to a rotating body. However, when measuring the torque applied to the rotating body using a torque sensor built in the rotary impact tool, a torque value signal indicating the torque may include noise components (components not contributing to a torque value) produced by impacts delivered to the rotating body of the rotary impact tool. Due to such noise components, it may be difficult to accurately control the drive apparatus. Accordingly, it is necessary to obtain an accurate torque value signal when measuring the torque applied to the rotating body of the rotary impact tool.

An object of the present disclosure is to provide a signal processing apparatus capable of obtaining a torque value signal more accurate than that of prior art, the torque value signal indicating a torque applied to a rotating body rotated by impacts delivered from a drive apparatus. Another object of the present disclosure is to provide a tool provided with such a signal processing apparatus.

Solution to Problem

According to an aspect of the present disclosure, a signal processing apparatus is provided for a tool provided with a rotating body rotated by impacts delivered from a drive apparatus. The signal processing apparatus is provided with: a filter that receives a torque value signal indicating a torque applied to the rotating body, and filters the torque value signal; a calculation circuit that sets a filter coefficient of the filter based on a number of impacts delivered to the rotating body; and a control circuit that controls the impacts delivered to the rotating body, based on the torque value signal filtered by the filter.

Advantageous Effects of Invention

The signal processing apparatus according to the one aspect of the present disclosure is capable of obtaining the torque value signal more accurate than that of prior art.

DESCRIPTION OF EMBODIMENTS

Embodiments of the present disclosure will be described below with reference to the drawings.

First Embodiment

Figure 1:
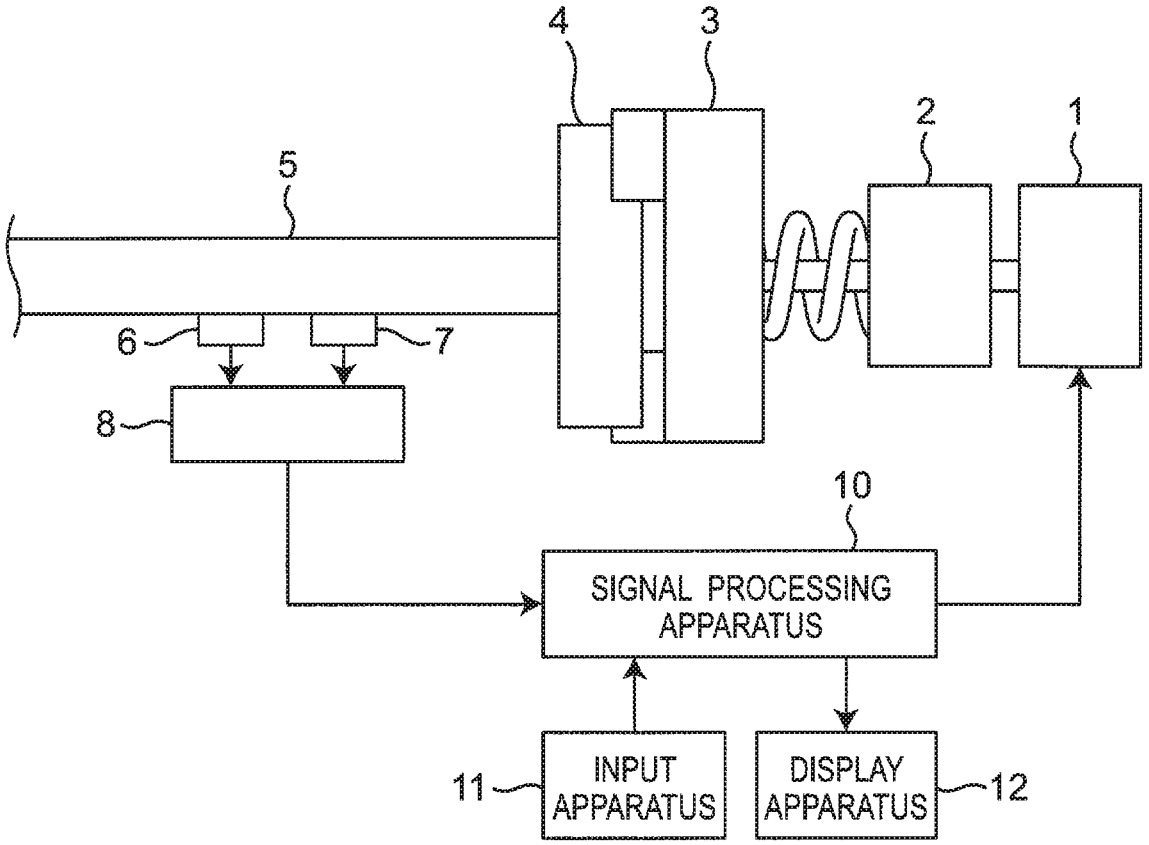
FIG. 1 is a schematic diagram showing a configuration of a tool according to a first embodiment.

FIG. 1 is a schematic diagram showing a configuration of a tool according to a first embodiment. The tool of FIG. 1 is provided with a motor 1, a speed reduction mechanism 2, a hammer 3, an anvil 4, a shaft 5, a torque sensor 6, an impact sensor 7, a split ring 8, a signal processing apparatus 10, an input apparatus 11, and a display apparatus 12. The tool of FIG. 1 is an impact driver provided with a rotating body rotated by impacts delivered from a drive apparatus.

The anvil 4 and the shaft 5 are integrally formed with each other. At a tip of the shaft 5 (an end opposite to the anvil 4), a bit holder (not shown) is provided for receiving a driver bit. The speed reduction mechanism 2 reduces a speed of rotation generated by the motor 1, and transmits the rotation to the hammer 3. The hammer 3 delivers an impact force to the anvil 4 to rotate the anvil 4 and the shaft 5.

The torque sensor 6 and the impact sensor 7 are fixed to the shaft 5. The torque sensor 6 detects a torque applied to the shaft 5, and outputs a torque value signal indicating the detected torque. The torque sensor 6 includes, for example, a strain sensor, a magnetostrictive sensor, or the like. The impact sensor 7 detects an impact delivered to the shaft 5, based on an impact delivered to the anvil 4 and the shaft 5, and outputs an impact pulse indicating the detected impact as a pulse. The impact sensor 7 includes, for example, an acceleration sensor, a microphone, or the like.

The split ring 8 transmits the torque value signal and the impact pulse from the shaft 5 to the signal processing apparatus 10 provided on a stationary part of the tool.

The input apparatus 11 receives user settings, indicating additional parameters associated with the tool's operation, from a user, and transmits the user settings to the signal processing apparatus 10. The additional parameters include, for example, at least any one of: a type of the tool's socket, a type of a target to be fastened, and a bolt diameter. The type of the socket includes, for example, the length of the sockets, such as 40 mm, 250 mm, and the like. The type of the target to be fastened includes, for example, a hard joint and a soft joint. The bolt diameter includes, for example, M8, M12, M14, and the like. The display apparatus 12 displays the tool's status, for example, the inputted user settings, the torque applied to the shaft 5, and the like. The signal processing apparatus 10 controls the motor 1 based on the torque value signal, the impact pulse, and the user settings. The motor 1 delivers impacts to the anvil 4 and the shaft 5, under control of the signal processing apparatus 10.

In the present disclosure, the anvil 4, the shaft 5, and the bit holder (not shown) are also referred to as the "rotating body". In addition, in the present disclosure, the motor 1, the speed reduction mechanism 2, and the hammer 3 are also referred to as the "drive apparatus".

Figure 2:
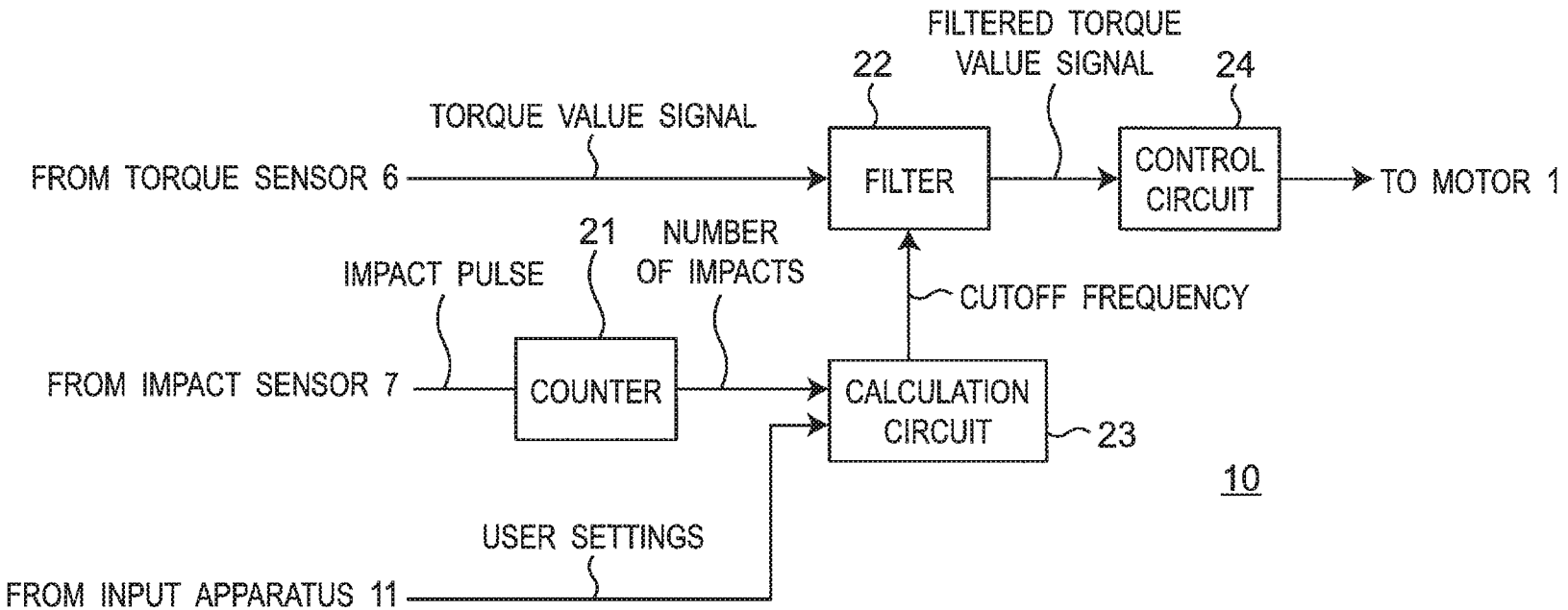
FIG. 2 is a block diagram showing a configuration of a signal processing apparatus 10 of FIG. 1.

FIG. 2 is a block diagram showing a configuration of the signal processing apparatus 10 of FIG. 1. The signal processing apparatus 10 is provided with: a counter 21, a filter 22, a calculation circuit 23, and a control circuit 24. The counter 21 counts the number of impacts delivered to the anvil 4 and the shaft 5, based on the impact pulses. The filter 22 receives a torque value signal, and filters the torque value signal. The filter 22 is a low-pass filter or a band-pass filter, which at least reduces frequency components higher than a variable cutoff frequency. The calculation circuit 23 sets a filter coefficient of the filter 22 based on the number of impacts and the user settings. The filter coefficient is, for example, a cutoff frequency of the filter 22. The control circuit 24 controls the impacts delivered to the anvil 4 and the shaft 5 from the motor 1, based on the torque value signal filtered by the filter 22. For example, when the torque applied to the shaft 5, indicated by the filtered torque value signal, reaches a predetermined value, the control circuit 24 stops the motor 1.

In the torque value signal, noise components would have frequencies higher than a frequency of a signal component of interest. Accordingly, in order to reduce the noise components of the torque value signal, it is expected to be effective to set a cutoff frequency to the filter 22. However, the inventors of the present application found that when fastening a screw or bolt using an impact driver, higher frequency components of the torque value signal gradually increase, as the number of impacts counted from the beginning of the fastening increases. This is possibly because the screw or bolt is more and more tightly fastened, as the number of impacts increases. Accordingly, when a fixed cutoff frequency is set to the filter 22, it may be difficult to appropriately reduce the noise components throughout the entire process from the beginning to the end of the fastening. According to the present disclosure, the calculation circuit 23 changes the cutoff frequency in accordance with the number of impacts. The calculation circuit 23 further sets the cutoff frequency based on the user settings. In other words, the calculation circuit 23 is configured with a calculation function for determining the cutoff frequency based on the number of impacts and the user settings. By setting the cutoff frequency of the filter 22 in this manner, the signal processing apparatus 10 can obtain an accurate torque value signal filtered so as to appropriately reduce the noise components throughout the entire process from the beginning to the end of the fastening.

The calculation function of the cutoff frequency is set to the calculation circuit 23, for example, using the machine learning.

Figure 3:
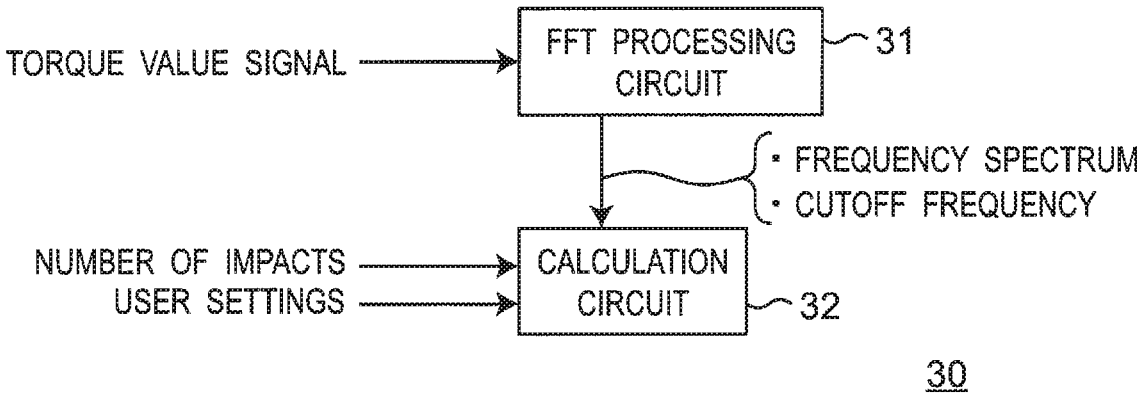
FIG. 3 is a block diagram showing a configuration of a learning apparatus 30 which determines an operation of a calculation circuit 23 of FIG. 2.

FIG. 3 is a block diagram showing a configuration of a learning apparatus 30 which determines an operation of the calculation circuit 23 of FIG. 2. The learning apparatus 30 is connected to the tool, and a test screw or bolt is fastened using the tool. At this time, a torque value signal and an impact pulse detected by the torque sensor 6 and the impact sensor 7 of the tool, respectively, are inputted to the learning apparatus 30. In addition, the same user settings as those of the tool are inputted to the learning apparatus 30. The learning apparatus 30 is provided with: a FFT processing circuit 31 and a calculation circuit 32. The FFT processing circuit 31 calculates at least one of a frequency spectrum of the torque value signal, and a cutoff frequency, and sends the calculated frequency spectrum or cutoff frequency to the calculation circuit 32. The calculation circuit 32 associates the torque value signal and the impact pulse, with the cutoff frequency.

Each of the calculation circuit 23 and the calculation circuit 32 is provided with, for example, a neural network.

Figure 4:
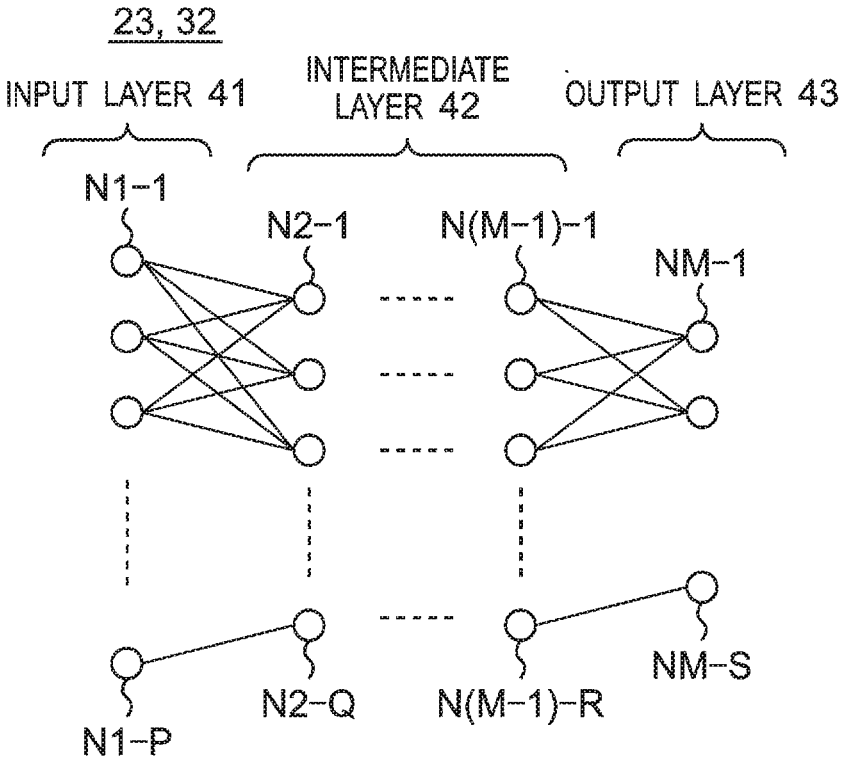
FIG. 4 is a diagram showing an example of a neural network used in each of the calculation circuit 23 of FIG. 2 and a calculation circuit 32 of FIG. 3.

FIG. 4 is a diagram showing an example of the neural network used in each of the calculation circuit 23 of FIG. 2 and the calculation circuit 32 of FIG. 3. The neural network is provided with: nodes N1-1 to N1-P of an input layer 41, nodes N2-1 to N2-Q, . . . , N(M−1)-1 to N(M−1)-R of at least one intermediate layer 42, and nodes NM-1 to NM-S of an output layer 43. The number of impacts and the additional parameters are set to the input layer 41 of the calculation circuit 32 of the learning apparatus 30. At least one of the frequency spectrum of the torque value signal, and the cutoff frequency, is set to the output layer 43 of the calculation circuit 32. Weighting coefficients of the intermediate layer 42 learned by the calculation circuit 32 of the learning apparatus 30 are set to the intermediate layer 42 of the calculation circuit 23 of the tool. The number of impacts and the additional parameters are inputted to the input layer 41 of the calculation circuit 23. At least one of the frequency spectrum of the torque value signal, and the cutoff frequency, is outputted from the output layer 43 of the calculation circuit 23.

The weighting coefficients of the intermediate layer 42 learned by the calculation circuit 32 of the learning apparatus 30 can be set to each of the intermediate layers 42 of the calculation circuits 23 of a plurality of the tools of the same model.

When the calculation circuit 23 outputs only the frequency spectrum of the torque value signal, a circuit for determining a cutoff frequency based on the frequency spectrum is added at a subsequent stage of the calculation circuit 23.

Figure 5:
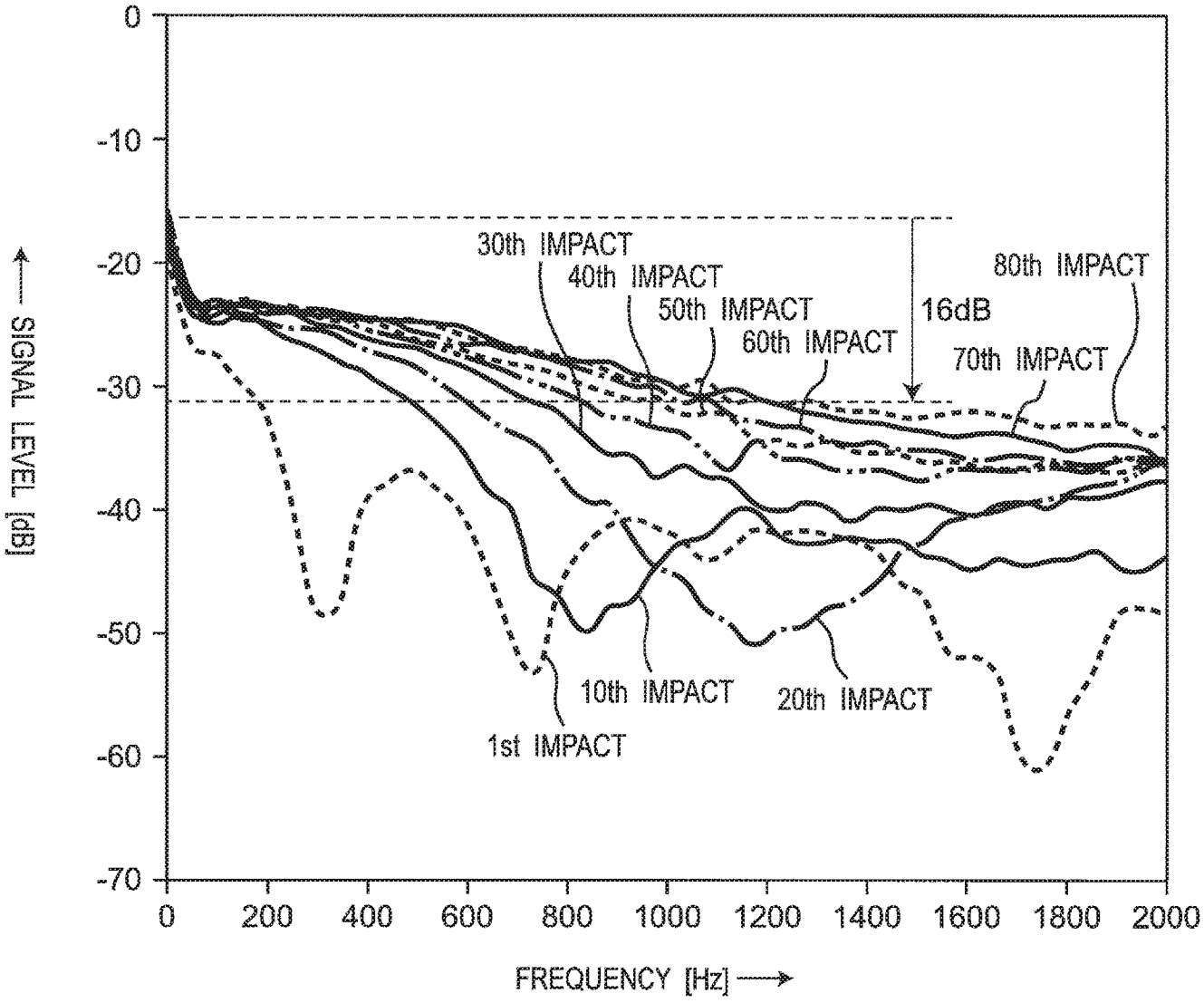
FIG. 5 is a graph for illustrating how to determine a cutoff frequency according to the first embodiment.

FIG. 5 is a graph for illustrating how to determine a cutoff frequency according to the first embodiment. According to the first embodiment, the cutoff frequency is set to a frequency corresponding to a signal level of a frequency spectrum of the torque value signal, the signal level being lower by a predetermined amount, in the example of FIG. 5, by 16 dB, than a peak of the frequency spectrum. As described above, when fastening a screw or bolt using an impact driver, higher frequency components of the torque value signal gradually increase, as the number of impacts counted from the beginning of the fastening increases. Accordingly, the cutoff frequency also increases, as the number of impacts increases.

Figure 6:
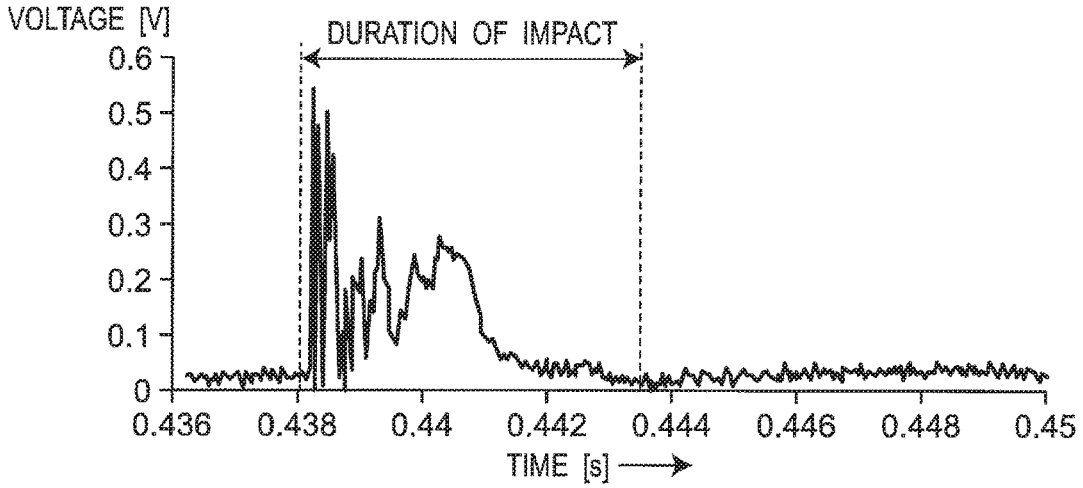
FIG. 6 is a graph showing a waveform of a torque signal at a first impact.
Figure 7:
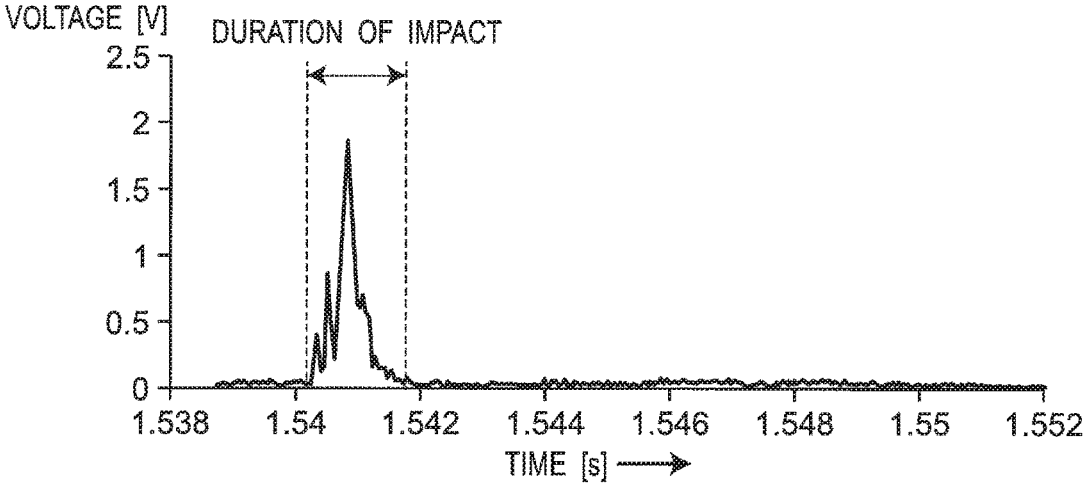
FIG. 7 is a graph showing a waveform of a torque signal at a 44th impact.
Figure 8:
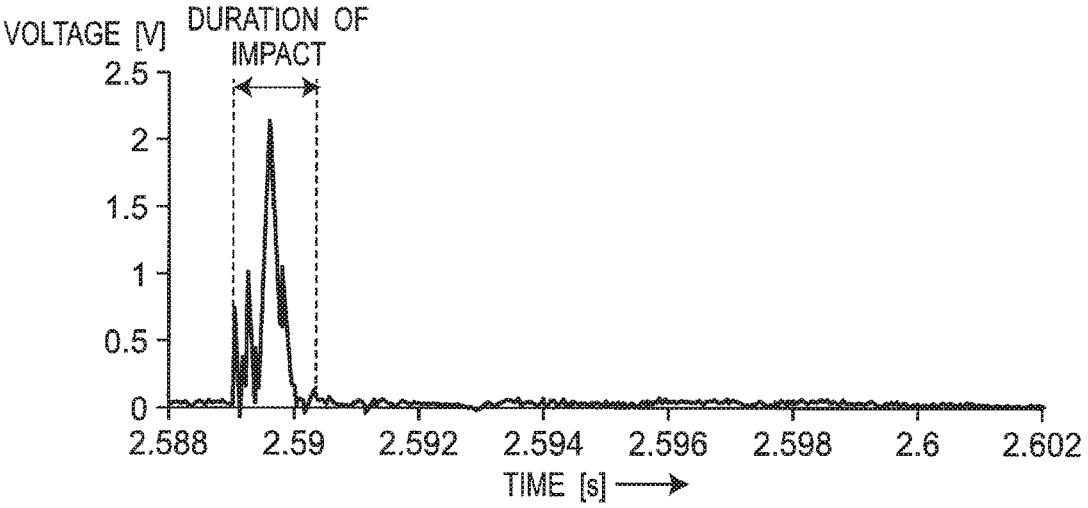
FIG. 8 is a graph showing a waveform of a torque signal at an 84th impact.

FIG. 6 is a graph showing a waveform of a torque signal at a first impact. FIG. 7 is a graph showing a waveform of a torque signal at a 44th impact. FIG. 8 is a graph showing a waveform of a torque signal at an 84th impact. In the cases of FIGS. 6 to 8, user settings, including: a type of the socket "socket length of 40 mm", a target to be fastened "hard joint", and a bolt diameter "M14", were used. It is understood from FIGS. 6 to 8 that the duration of impact decreases, as the number of impacts increases. In addition, in this case, higher frequency components of the torque value signal gradually increase, as the number of impacts increases.

Figure 9:
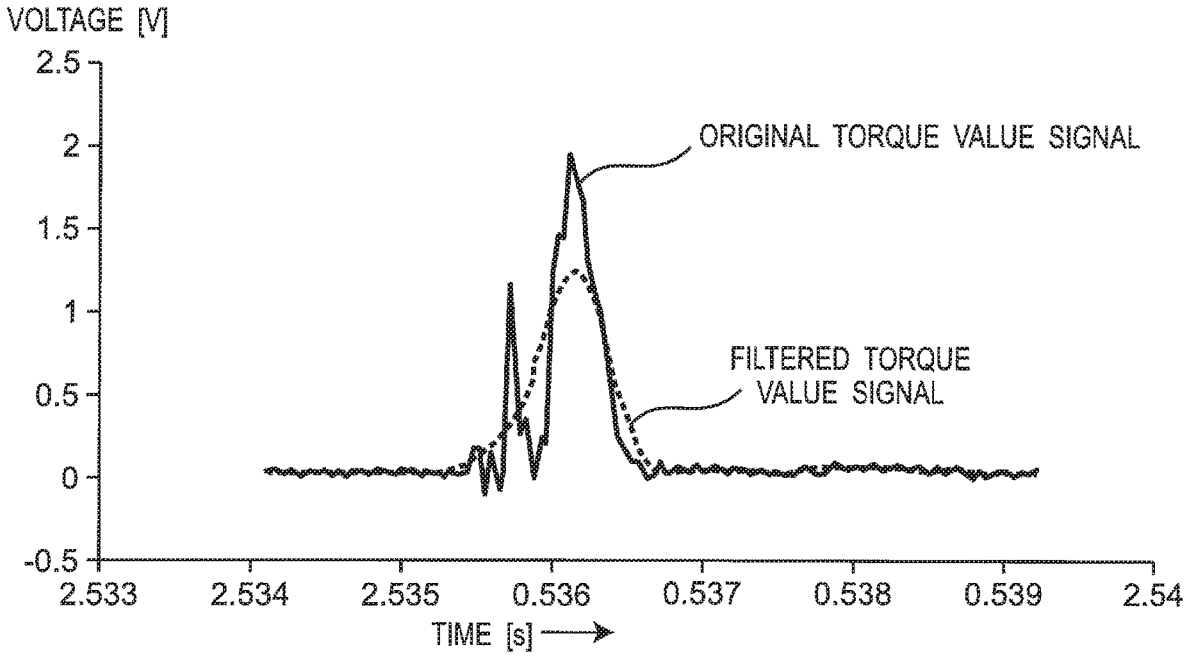
FIG. 9 is a graph showing filtering of a torque value signal according to the first embodiment.

FIG. 9 is a graph showing filtering of the torque value signal according to the first embodiment. A torque value signal filtered so as to reduce noise components is obtained by using a cutoff frequency determined in the manner described above.

Figure 10:
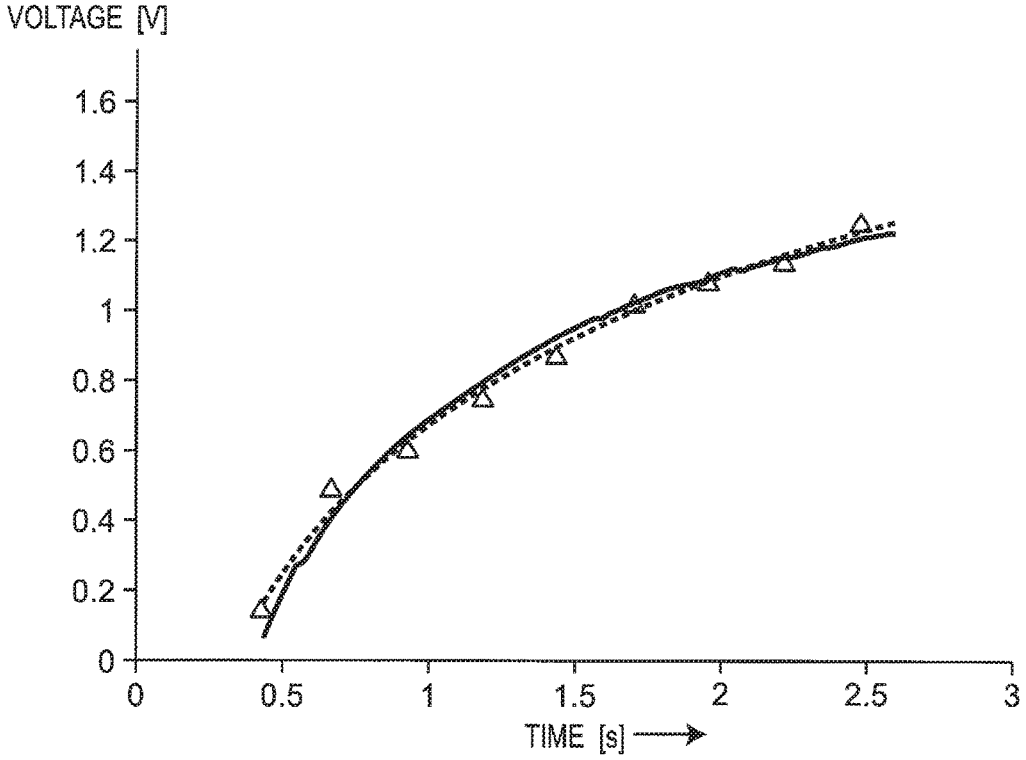
FIG. 10 is a graph comparing a torque value signal filtered using a cutoff frequency determined according to the first embodiment, with an actually measured torque value signal.

FIG. 10 is a graph comparing a torque value signal filtered using a cutoff frequency determined according to the first embodiment, with an actually measured torque value signal. The graph of FIG. 10 shows values of the torque value signal obtained when 40 impacts per second are delivered to the anvil 4 and the shaft 5. A solid line indicates torque values actually measured by an external measuring instrument. Triangular plots indicate values of the filtered torque value signal at 10th, 20th, . . . , and 90th impacts. A broken line indicates an approximation for the value of the filtered torque value signal, "$y=a\times\ln(x)+b$" of, where "x" denotes time (corresponding to the number of impacts), "y" denotes voltage, and "a" and "b" denote coefficients variable in accordance with the additional parameters. It is understood from FIG. 10 that the values of the filtered torque value signal significantly match with the actually measured torque values.

The signal processing apparatus 10 controls the impacts delivered from the motor 1 to the anvil 4 and the shaft 5, based on the torque value signal filtered using the cutoff frequency determined in the manner as described above. The signal processing apparatus 10 may display the torque applied to the shaft 5, indicated by the filtered torque value signal, on the display apparatus 12.

According to the tool of the first embodiment, it is possible to obtain the accurate torque value signal filtered so as to appropriately reduce noise components, by changing the cutoff frequency in accordance with the number of impacts.

The calculation circuit 23 may be provided with a table in which the torque value signal and the impact pulse are associated with the cutoff frequency, instead of the neural network.

The calculation circuit 23 may set a filter coefficient other than the cutoff frequency, to the filter 22. For example, when the filter 22 is a band-pass filter, the calculation circuit 23 may set an upper limit frequency and a lower limit frequency to the filter 22.

The counter 21 may be integrally formed with the impact sensor 7, rather than provided on the signal processing apparatus 10. Further, the counter 21 may be provided separately from the signal processing apparatus 10 and the impact sensor 7.

The signal processing apparatus and the tool according to the first embodiment are characterized by the following configurations.

According to the signal processing apparatus of the first embodiment, the signal processing apparatus 10 for a tool provided with a rotating body rotated by impacts delivered from a drive apparatus is provided with: a filter 22 a calculation circuit 23 and a control circuit 24. The filter 22 receives a torque value signal indicating a torque applied to the rotating body, and filters the torque value signal. The calculation circuit 23 sets a filter coefficient of the filter 22 based on a number of impacts delivered to the rotating body. The control circuit 24 controls the impacts delivered to the rotating body, based on the torque value signal filtered by the filter 22.

Thus, it is possible to obtain the accurate torque value signal filtered so as to appropriately reduce noise components, by setting the filter coefficient of the filter 22 based on the number of impacts delivered to the rotating body.

According to the signal processing apparatus of the first embodiment, the filter coefficient may be a cutoff frequency of the filter 22.

Thus, it is possible to obtain the accurate torque value signal filtered so as to appropriately reduce noise components.

According to the signal processing apparatus of the first embodiment, the cutoff frequency may be set to a frequency corresponding to a signal level of a frequency spectrum of the torque value signal, the signal level being lower by a predetermined amount than a peak of the frequency spectrum.

Thus, it is possible to appropriately set the cutoff frequency based on the number of impacts delivered to the rotating body.

According to the tool of the first embodiment, the tool is provided with: a rotating body, a torque sensor 6, a counter 21, the signal processing apparatus 10, and a motor 1. The torque sensor 6 detects a torque applied to the rotating body, and generates a torque value signal indicating the torque. The counter 21 counts a number of impacts delivered to the rotating body. The motor 1 delivers impacts to the rotating body under control of the signal processing apparatus 10.

Thus, it is possible to appropriately control the motor 1 based on the accurate torque value signal.

According to the tool of the first embodiment, the calculation circuit 23 of the signal processing apparatus 10 may set the filter coefficient of the filter 22 further based on additional parameters including at least one of: a socket type of the tool, a type of a target to be fastened, and a bolt diameter.

Thus, it is possible to appropriately set the cutoff frequency based on the additional parameters.

According to the tool of the first embodiment, the tool may be further provided with an input apparatus that receives user settings indicating the additional parameters.

Thus, it is possible to appropriately set the cutoff frequency based on the additional parameters.

According to the tool of the first embodiment, the calculation circuit 23 may be provided with a neural network, including an input layer 41, at least one intermediate layer 42, and an output layer 43. To the input layer 41, the number of impacts and the additional parameters are inputted. From the output layer 43, at least one of a frequency spectrum of the torque value signal generated by the torque sensor 6, and a cutoff frequency, is outputted.

Thus, it is possible to appropriately set the cutoff frequency based on the number of impacts delivered to the rotating body, and based on the additional parameters.

Second Embodiment

The cutoff frequency of the filter 22 may be determined based on a criterion other than that described above.

Figure 11:
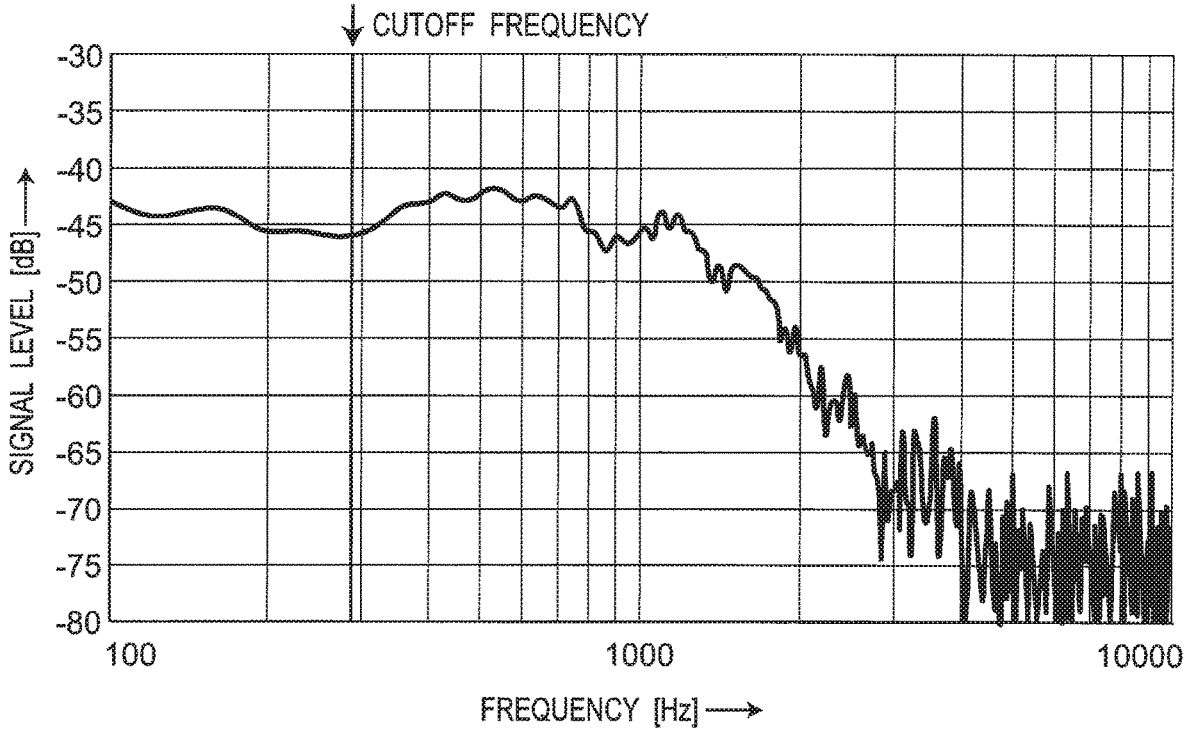
FIG. 11 is a graph for illustrating how to determine a cutoff frequency of a torque value signal for a tool according to a second embodiment, the graph showing a frequency spectrum of a torque signal at a first impact.
Figure 12:
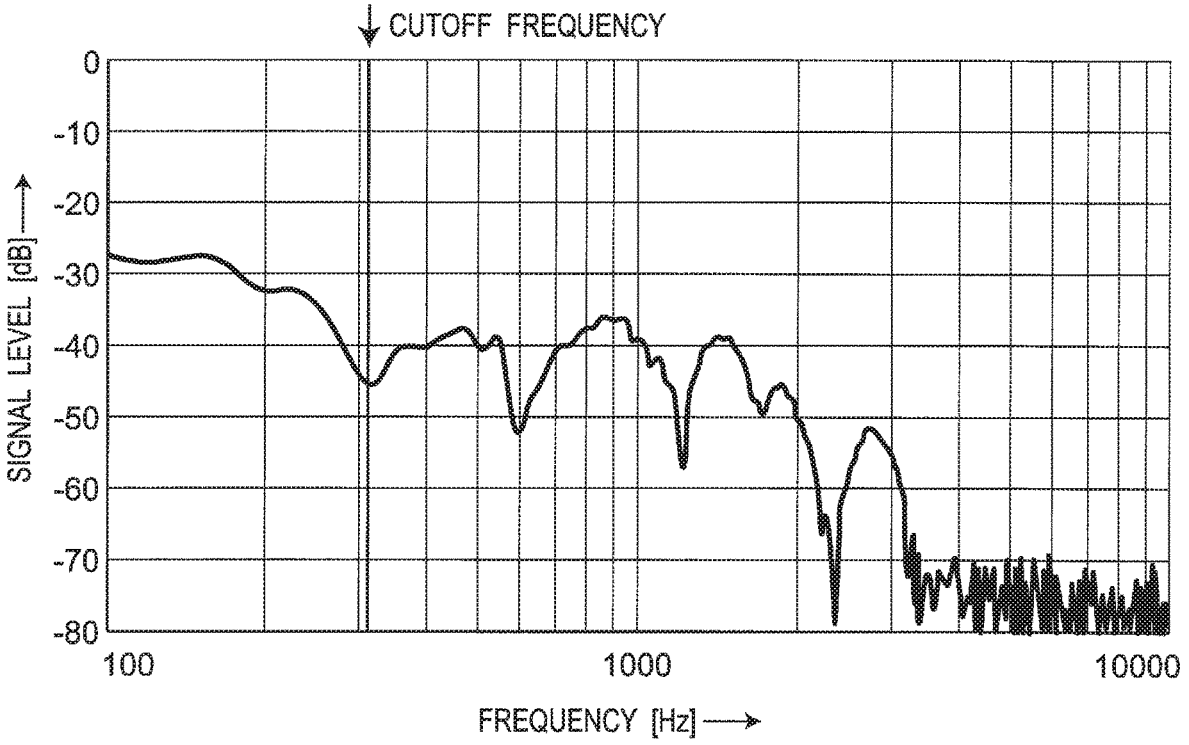
FIG. 12 is a graph for illustrating how to determine the cutoff frequency of the torque value signal for the tool according to the second embodiment, the graph showing a frequency spectrum of a torque signal at a fifth impact.
Figure 13:
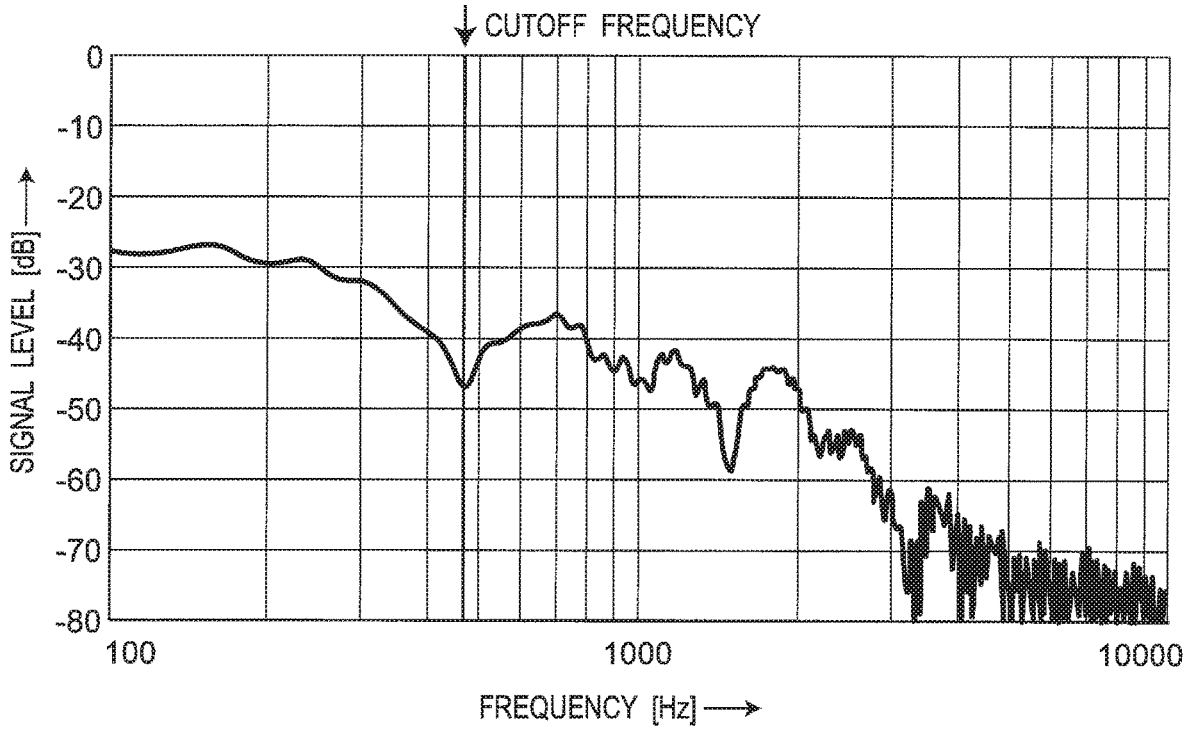
FIG. 13 is a graph for illustrating how to determine the cutoff frequency of the torque value signal for the tool according to the second embodiment, the graph showing a frequency spectrum of a torque signal at a 10th impact.
Figure 14:
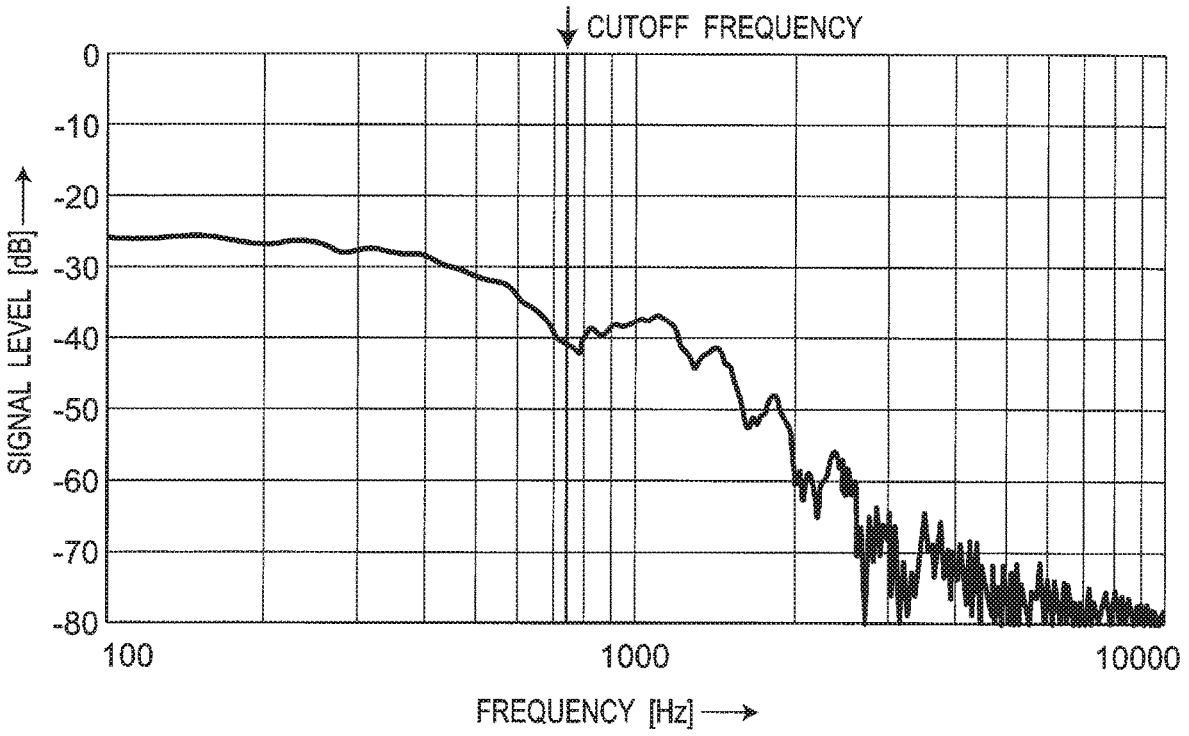
FIG. 14 is a graph for illustrating how to determine the cutoff frequency of the torque value signal for the tool according to the second embodiment, the graph showing a frequency spectrum of a torque signal at a 20th impact.
Figure 15:
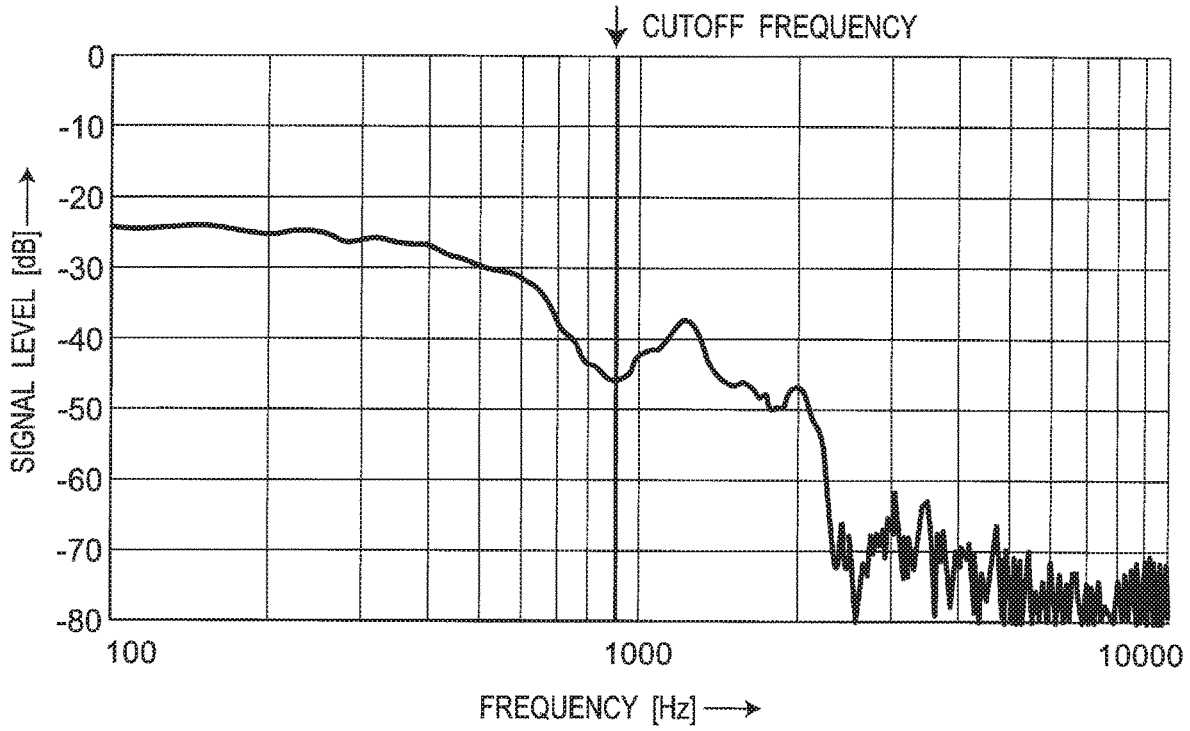
FIG. 15 is a graph for illustrating how to determine the cutoff frequency of the torque value signal for the tool according to the second embodiment, the graph showing a frequency spectrum of a torque signal at a 30th impact.
Figure 16:
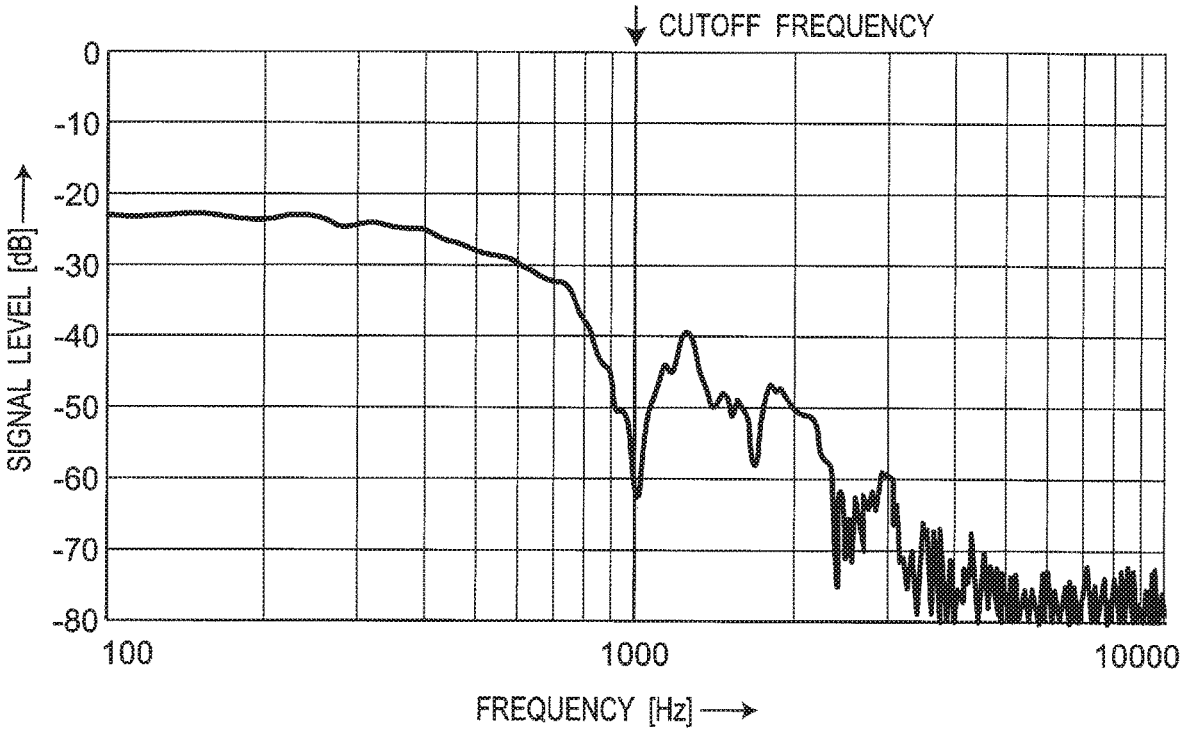
FIG. 16 is a graph for illustrating how to determine the cutoff frequency of the torque value signal for the tool according to the second embodiment, the graph showing a frequency spectrum of a torque signal at a 40th impact.

FIGS. 11 to 16 are graphs for illustrating how to determine a cutoff frequency for a torque value signal of a tool according to a second embodiment. FIG. 11 is a graph showing a frequency spectrum of a torque signal at a first impact. FIG. 12 is a graph showing a frequency spectrum of a torque signal at a fifth impact. FIG. 13 is a graph showing a frequency spectrum of a torque signal at a 10th impact. FIG. 14 is a graph showing a frequency spectrum of a torque signal at a 20th impact. FIG. 15 is a graph showing a frequency spectrum of a torque signal at a 30th impact. FIG. 16 is a graph showing a frequency spectrum of a torque signal at a 40th impact. As described above, when fastening a screw or bolt using an impact driver, higher frequency components of the torque value signal gradually increase, as the number of impacts counted from the beginning of the fastening increases. According to the second embodiment, the cutoff frequency is set to a frequency corresponding to a signal level of a frequency spectrum of the torque value signal, the signal level being a first local minimum found when sweeping from a low frequency to a high frequency in the frequency spectrum.

According to the tool of the second embodiment, it is possible to obtain the accurate torque value signal filtered so as to appropriately reduce noise components, by changing the cutoff frequency in accordance with the number of impacts, in a manner similar to that of the first embodiment.

The signal processing apparatus and the tool according to the second embodiment are characterized by the following configurations.

According to the signal processing apparatus and the tool of the second embodiment, the cutoff frequency may be set to a frequency corresponding to a signal level of a frequency spectrum of the torque value signal, the signal level being a first local minimum found when sweeping from a low frequency to a high frequency in the frequency spectrum.

Thus, it is possible to obtain the accurate torque value signal filtered so as to appropriately reduce noise components, by changing the cutoff frequency based on the number of impacts.

Each of the embodiments of the present disclosure can be applied to, not limited to the impact driver, but other tools, such as an impact wrench, provided with a rotating body rotated by impacts delivered from a drive apparatus.

REFERENCE SIGNS LIST

1: MOTOR
2: SPEED REDUCTION MECHANISM
3: HAMMER
4: ANVIL
5: SHAFT
6: TORQUE SENSOR
7: IMPACT SENSOR
8: SPLIT RING
10: SIGNAL PROCESSING APPARATUS
11: INPUT APPARATUS
12: DISPLAY APPARATUS
21: COUNTER
22: FILTER
23: CALCULATION CIRCUIT
24: CONTROL CIRCUIT
31: FFT PROCESSING CIRCUIT
32: CALCULATION CIRCUIT
41: INPUT LAYER
42: INTERMEDIATE LAYER
43: OUTPUT LAYER

The invention claimed is:

1. A signal processing apparatus for a tool comprising a rotating body rotated by impacts delivered from a drive apparatus, the signal processing apparatus comprising:

a filter that receives a torque value signal indicating a torque applied to the rotating body, and filters the torque value signal;

a counter that counts a number of impacts delivered to the rotating body;

a calculation circuit configured to set a filter coefficient of the filter based on the number of impacts delivered to the rotating body; and a control circuit configured to control the impacts delivered to the rotating body, based on the torque value signal filtered by the filter.

2. The signal processing apparatus as claimed in claim 1, wherein the filter coefficient is a cutoff frequency of the filter.

3. The signal processing apparatus as claimed in claim 2, wherein the cutoff frequency is set to a frequency corresponding to a signal level of a frequency spectrum of the torque value signal, the signal level being lower by a predetermined amount than a peak of the frequency spectrum.

4. The signal processing apparatus as claimed in claim 2, wherein the cutoff frequency is set to a frequency corresponding to a signal level of a frequency spectrum of the torque value signal, the signal level being a first local minimum found when sweeping from a low frequency to a high frequency in the frequency spectrum.

5. A tool comprising:

a rotating body;

a torque sensor that detects a torque applied to the rotating body, and generates a torque value signal indicating the torque;

a counter that counts a number of impacts delivered to the rotating body;

a signal processing apparatus; and a drive apparatus that delivers impacts to the rotating body under control of the signal processing apparatus, wherein the signal processing apparatus comprises:

a filter that receives a torque value signal indicating a torque applied to the rotating body, and filters the torque value signal;

a calculation circuit configured to set a filter coefficient of the filter based on the number of impacts delivered to the rotating body; and a control circuit configured to control the impacts delivered to the rotating body, based on the torque value signal filtered by the filter.

6. The tool as claimed in claim 5, wherein the calculation circuit of the signal processing apparatus sets the filter coefficient of the filter further based on additional parameters including at least one of: a socket type of the tool, a type of a target to be fastened, and a bolt diameter.

7. The tool as claimed in claim 6, further comprising an input apparatus that receives user settings indicating the additional parameters.

8. The tool as claimed in claim 6, wherein the calculation circuit comprises a neural network, including:

an input layer to which the number of impacts and the additional parameters are inputted;

at least one intermediate layer; and an output layer from which at least one of a frequency spectrum of the torque value signal generated by the torque sensor, and a cutoff frequency, is outputted.

* * * * *